US009371219B2

(12) United States Patent
Metropulos et al.

(10) Patent No.: US 9,371,219 B2
(45) Date of Patent: Jun. 21, 2016

(54) SYSTEM AND METHOD FOR DISPENSING A BEVERAGE

(71) Applicant: Smart Bar USA LLC, Crystal Lake, IL (US)

(72) Inventors: William Metropulos, McHenry, IL (US); Tim Knecht, Crystal Lake, IL (US)

(73) Assignee: Smart Bar USA LLC, McHenry, IL (US)

( * ) Notice: Subject to any disclaimer, the term of this patent is extended or adjusted under 35 U.S.C. 154(b) by 0 days.

(21) Appl. No.: 14/299,413

(22) Filed: Jun. 9, 2014

(65) Prior Publication Data

US 2014/0284349 A1 Sep. 25, 2014

Related U.S. Application Data

(63) Continuation of application No. 13/165,452, filed on Jun. 21, 2011, now Pat. No. 8,746,507.

(60) Provisional application No. 61/356,750, filed on Jun. 21, 2010.

(51) Int. Cl.
*B67D 7/74* (2010.01)
*B67D 1/00* (2006.01)
(Continued)

(52) U.S. Cl.
CPC ..... *B67D 1/0041* (2013.01); *B67D 1/0888* (2013.01); *G07F 9/026* (2013.01); *G07F 13/02* (2013.01); *G07F 13/065* (2013.01); *B67D 1/0022* (2013.01)

(58) Field of Classification Search
CPC .. B67D 1/0041; B67D 1/0022; B67D 1/0017; B67D 1/0888; G67F 13/065; G07F 9/2016; G07F 13/02; G07F 13/068
USPC ..... 222/129.1, 129.2, 129.4, 52, 63; 700/231, 236, 239, 241, 242
See application file for complete search history.

(56) References Cited

U.S. PATENT DOCUMENTS 2,876,806 A 3/1959 Kirk et al.
3,592,367 A 7/1971 Landis et al.
(Continued)

FOREIGN PATENT DOCUMENTS

CN 101300190 2/2013
FR 2624844 6/1989
(Continued)

OTHER PUBLICATIONS

International Search Report dated Nov. 3, 2011 for International Application No. PCT/US2011/041254.
(Continued)

*Primary Examiner* — Lien Ngo
(74) *Attorney, Agent, or Firm* — McDermott Will & Emery LLP

(57) ABSTRACT

A method and system for managing the dispensing of beverages from an automatic beverage dispensing unit. The beverages may be comprised of a single or multiple ingredients, including a first plurality of liquids, a second plurality of liquids, and/or a combination of one or more first and second plurality of liquids. In addition, garnishes and sides may be included in the beverage. The beverages are dispensed according to a pouring schema. The pouring schema may be a beverage recipe and may be preprogrammed by a system manager, or alternatively, be chosen by a consumer during operation of the system. The first plurality of liquids may include liquors and the second plurality of beverages may include mixers which are mixed with the liquors to create the beverage.

12 Claims, 8 Drawing Sheets

(51) Int. Cl.

| | |
|---|---|
| ***B67D 1/08*** | (2006.01) |
| ***G07F 9/02*** | (2006.01) |
| ***G07F 13/02*** | (2006.01) |
| ***G07F 13/06*** | (2006.01) |

(56) References Cited

U.S. PATENT DOCUMENTS

| | | | | |
|---|---|---|---|---|
| 3,940,019 | A | 2/1976 | Kross et al. | |
| 4,162,028 | A | 7/1979 | Reichenberger | |
| 4,276,999 | A | 7/1981 | Reichenberger | |
| 4,392,588 | A | 7/1983 | Scalera | |
| 4,708,266 | A | 11/1987 | Rudick | |
| 4,961,447 | A | 10/1990 | Credle, Jr. et al. | |
| 5,129,511 | A | 7/1992 | Brown et al. | |
| 5,251,790 | A | 10/1993 | Cohn et al. | |
| 5,731,981 | A | 3/1998 | Simard | |
| 5,967,367 | A | 10/1999 | Orsborn | |
| 6,036,055 | A | 3/2000 | Mogadam et al. | |
| 7,356,381 | B2 * | 4/2008 | Crisp, III | 700/242 |
| 7,806,294 | B2 | 10/2010 | Gatipon et al. | |
| 7,913,879 | B2 | 3/2011 | Carpenter et al. | |
| 8,032,251 | B2 | 10/2011 | Monn | |
| 8,245,739 | B1 | 8/2012 | Wade et al. | |
| 8,290,616 | B2 | 10/2012 | Crisp, III | |
| 8,322,570 | B2 | 12/2012 | Beavis et al. | |
| 9,020,635 | B2 * | 4/2015 | Hortin | 700/233 |
| 2005/0115989 | A1 | 6/2005 | Ludovissie et al. | |
| 2006/0118581 | A1 | 6/2006 | Clark | |
| 2006/0138170 | A1 | 6/2006 | Brim et al. | |
| 2007/0106565 | A1 * | 5/2007 | Coelho | 705/26 |
| 2007/0114244 | A1 | 5/2007 | Gatipon et al. | |
| 2007/0239549 | A1 | 10/2007 | LaFauci et al. | |
| 2007/0265935 | A1 * | 11/2007 | Woycik et al. | 705/26 |
| 2007/0272742 | A1 | 11/2007 | Gosi et al. | |
| 2008/0004973 | A1 | 1/2008 | Rothschild | |
| 2009/0069931 | A1 | 3/2009 | Peters et al. | |
| 2009/0069934 | A1 | 3/2009 | Newman et al. | |
| 2009/0069947 | A1 | 3/2009 | Newman | |
| 2010/0198643 | A1 | 8/2010 | Friedman et al. | |
| 2011/0017776 | A1 * | 1/2011 | Metropulos et al. | 222/129.1 |
| 2012/0035761 | A1 | 2/2012 | Tilton et al. | |
| 2013/0304265 | A1 | 11/2013 | Deo et al. | |

FOREIGN PATENT DOCUMENTS

| | | |
|---|---|---|
| GB | 1 401 185 | 7/1975 |
| GB | 2451508 | 5/2010 |
| WO | 2009032874 | 3/2009 |

OTHER PUBLICATIONS

Written Opinion dated Nov. 3, 2011 for International Application No. PCT/US2011/041254.

Patent Examination Report No. 1, issued by Australian Patent Office for related Australian Patent Application No. 2011271145, issued Sep. 12, 2014.

* cited by examiner

SYSTEM AND METHOD FOR DISPENSING A BEVERAGE

RELATED APPLICATIONS

This application is a continuation of U.S. patent application Ser. No. 13/165,452, filed Jun. 21, 2011 (to issue as U.S. Pat. No. 8,746,507 on Jun. 10, 2014), which claims priority to U.S. Provisional Application No. 61/356,750, filed Jun. 21, 2010, the disclosures of which are incorporated herein by reference.

TECHNICAL FIELD

The present invention generally relates to a system and method for dispensing a beverage, and in particular to a method and system for managing the dispensation of beverages from an automatic beverage dispensing unit.

BACKGROUND

Beverage dispensing systems that provide delivery of beverages to a customer are well known in the art. Typically, such beverage dispensing machines permit a customer to specify a beverage to be dispensed and allow the customer to dispense the specified beverage. Such beverages may be, for example, flavored carbonated beverages, coffee-based beverages, and alcoholic beverages such as beer and wine.

A major drawback of current beverage dispensing systems is the lack of customization which is offered in such systems. For example, current beverage dispensing systems do not permit management of various functions of the beverage dispensing system such as creating or revising beverage recipes for the beverages which are dispensed, creating or revising menus of the different beverages that may be dispensed, product management and inventory tracking, reviewing dispensing history, and financial tracking, such as tracking volume, count, and sales of beverages which are dispensed by beverage dispensing function. In addition, current beverage dispensing systems do not provide the ability to dispense customized beverages based on ingredients that are provided by the beverage dispensing system. Rather, such systems generally include only predetermined beverages which may be dispensed.

The present system is provided to solve the problems discussed above and other problems, and to provide advantages and aspects not previously provided. A full discussion of the features and advantages of the present system is deferred to the following detailed description, which proceeds with reference to the accompanying drawings.

SUMMARY

A method and system for managing the dispensing of beverages from an automatic beverage dispensing unit is provided herein. The beverages may be comprised of a single or multiple ingredients, including a first plurality of liquids, a second plurality of liquids, and/or a combination of one or more first and second plurality of liquids. In addition, garnishes and sides may be included in the beverage. The beverages are dispensed according to a pouring schema. The pouring schema may be a beverage recipe and may be preprogrammed by a system manager, or alternatively, be chosen by a consumer during operation of the system. In addition, it is contemplated that the pouring schema may be programmed by another individual. In one embodiment, the first plurality of liquids may include liquors and the second plurality of beverages may include mixers which are mixed with the liquors to create the beverage.

In addition, a system for managing the dispensing of beverages from an automatic beverage dispensing unit is provided. The system may comprise an input module, a memory, a processor, and an output module. The input module may receive a plurality of pouring schema wherein each of the plurality of pouring schema is a beverage recipe. The input module may allow for selection of at least one criteria to be used in the beverage recipe. The memory may store the plurality of pouring schema and the processor may process the pouring schema. The output module may display instructions based on the pouring schema. The automatic beverage dispensing unit may comprise a supply pack containing one or more ingredients to be used with one or more of the pouring schema. The system may include a priming input module for receiving priming instructions for energizing one or mechanisms for priming at least one supply pack. The system may also include a plurality of user accounts and the received plurality of pouring schema is associate with at least one of the user accounts.

The system may further include an access module for setting access permissions for access to one or more of the pouring schema and a beverage dispensing unit setup module for selecting criteria available for use for a pouring schema. The criteria may include at least one of selecting at least one ingredient to be used in the beverage recipe, selecting the size of the beverage, and selecting the amount of the at least one ingredient to be used in the beverage recipe. The beverage recipe may include one of a first plurality of liquids and one of a second plurality of liquids. The first plurality of liquids may comprise liquor and the second plurality of liquids may comprise mixers. The pouring schema may include mixing at least one of the first plurality of liquids with at least one of the second plurality of liquids.

The system may also include a second input module for receiving a beverage request for a beverage corresponding to a beverage recipe, wherein the processor processes the pouring schema corresponding to the beverage recipe. Further, the system may include a second memory for storing information relating to one or more beverages dispensed by the system during a report session. The information may include at least one of the number of beverages dispensed over the report session, the start time for the report session, time the first beverage is dispensed, the time the last beverage is dispensed, the end time for the report session, the type of consumer, the types of beverages dispensed, the total volume of beverages dispensed, and the size of the beverages dispensed.

A system for managing the dispensing of beverages from an automatic beverage dispensing unit comprising an input module, a memory, a processor, and an output module is also provided. The input module may receive a plurality of pouring schema wherein each of the plurality of pouring schema is a beverage recipe. The input module may allow for selection of at least one accounting criteria to track accounting data for one or more beverages dispensed by the automatic beverage dispensing unit. The memory may store the plurality of pouring schema and the at least one accounting criteria. The processor may process the pouring schema and the at least one accounting criteria. The output module may provide accounting data corresponding to the at least one accounting criteria based on use of the automatic beverage dispensing unit. The output module may include a display and the accounting data is displayed on the display.

The accounting criteria may include at least one of the number of beverages dispensed over a report session, the start time for the report session, time the first beverage is dispensed, the time the last beverage is dispensed, the end time for the report session, the type of consumer, the types of beverages dispensed, the total volume of beverages dispensed, and the size of the beverages dispensed. The accounting data may be stored in the memory and can be transferred to an external memory.

A system for dispensing beverages from an automatic beverage dispensing unit is also provide. The system includes a memory, an input module, a processor, and an output module. The memory may store a plurality of pouring schema wherein each of the plurality of pouring schema corresponds to a beverage recipe. The input module may display at least one beverage recipe and receive a selection of a beverage request corresponding to a displayed beverage recipe. The input module may include a touch screen interface for allowing selection of a beverage request. The input module may also provide a plurality of beverage category input selections. Each input selection may correspond to one of a plurality of beverage categories and selection of the input selection provides a list of beverages which may be dispensed by the automatic dispensing unit. The processor may process the pouring schema based on the beverage request. The output module may display instructions for a user wherein the displays instructions correspond to the beverage recipe. The output module may include a touch screen interface for displaying instructions for a user. The system may also include a search module for allowing the user to search for a beverage based on a search criteria, wherein the results of the search are displayed on the output module.

Other features and advantages will be apparent from the following specification taken in conjunction with the following drawings.

BRIEF DESCRIPTION OF THE DRAWINGS

To understand the present invention, it will now be described by way of example only, not by way of limitation, with reference to the accompanying drawings in which.

DETAILED DESCRIPTION

Figure 1:
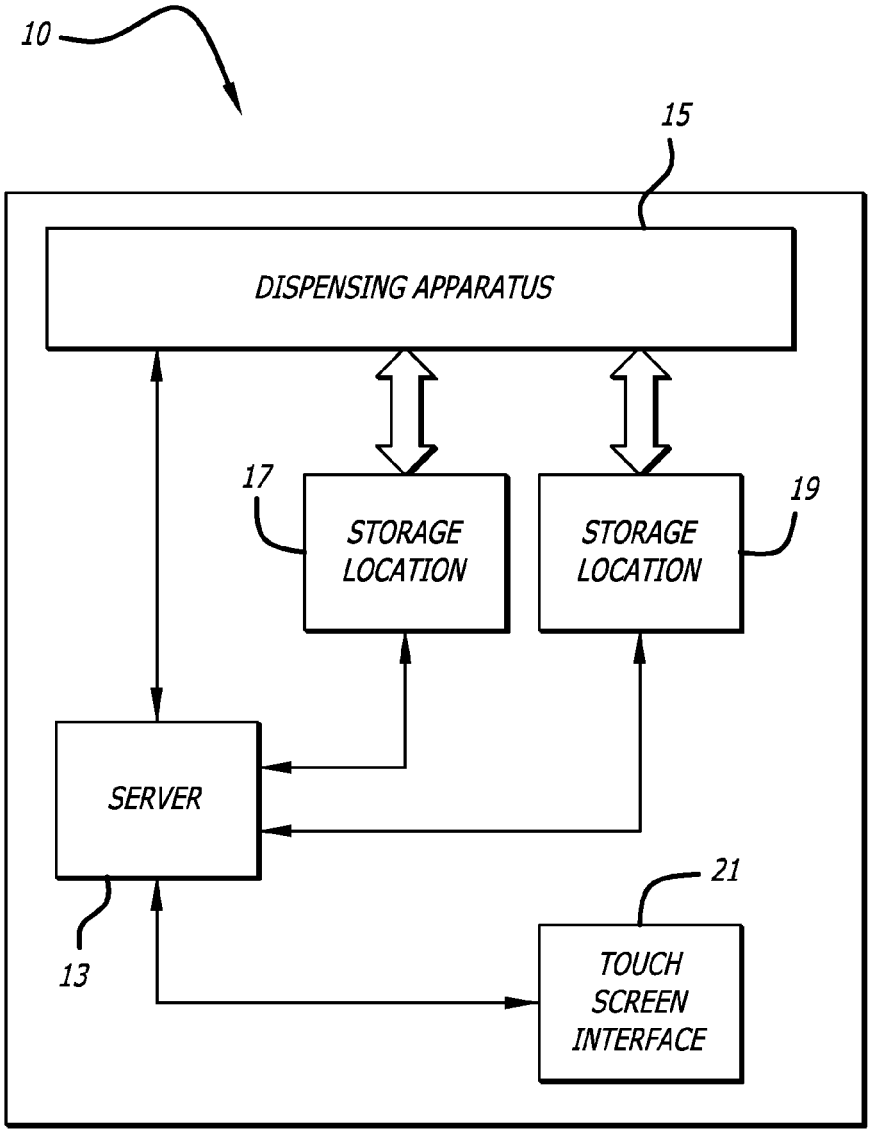
FIG. 1 is a block diagram illustrating a beverage dispensing system.

While this invention is susceptible of embodiments in many different forms, there is shown in the drawings and will herein be described an example of the invention with the understanding that the present disclosure is to be considered as an exemplification of the principles of the invention and is not intended to limit the broad aspect of the invention to the examples illustrated.

Referring to FIGS. 1-5D, a method and system for managing and dispensing beverages from an automatic beverage dispensing unit is provided. The beverages may be comprised of a single or multiple ingredients, including a first plurality of liquids, a second plurality of liquids, and/or a combination of one or more first and second plurality of liquids. In addition, garnishes and sides may be included in the beverage. The beverages are dispensed according to a pouring schema. The pouring schema may be a beverage recipe and may be preprogrammed by a system manager, or alternatively, be chosen by a consumer during operation of the system. In addition, it is contemplated that the pouring schema may be programmed by another individual. In one embodiment, the first plurality of liquids may include liquors and the second plurality of beverages may include mixers which are mixed with the liquors to create the beverage.

The first plurality of beverages may include at least one of the following ingredients: amaretto, bourbon, brandy, gin, Irish crème, Jagermeister®, Kahlua®, light rum, peach schnapps, scotch, spiced rum, sweet vermouth, tequila, triple sec, vodka, and whiskey. The second plurality of beverages may include one of the following ingredients: bloody mary, club soda, cola, cranberry juice, diet cola, energy drink, ginger ale, grapefruit juice, lemon lime soda, lemonade, lime juice, orange juice, pineapple juice, sour mix, tonic, and water. The garnishes may include at least one of the following ingredients: banana, carrot, celery stick, cherry, cocktail onion, lemon peel, lemon wedge, lime wedge, olive, orange slice, orange wedge, and pineapple wedge. The sides may include at least one of the following: Campari®, cream, dash of bitters, dash of celery salt, dash of salt, dash of Worcestershire®, Galliano, lemon juice, dry vermouth, grenadine, sugar syrup, half and half, sugar cube, and Tabasco®. It is understood however, that the first plurality of beverages, the second plurality of beverages, the garnishes, and the sides may include additional ingredients to the ingredients listed above.

FIG. 1 is a block diagram of a beverage dispensing system 10. The beverage dispensing system 10 includes a server 13, a dispensing apparatus 15, a storage location for a plurality of first liquids 17, a storage location for a plurality of second liquids 19, and an operator interface 21. In one embodiment, the operator interface comprises a touch screen 21. As will be described in greater detail herein, the beverage dispensing system 10 may be programmed to dispense various combinations of liquors and mixers in a precise amount. In addition, the beverage dispensing system 10 may include management functionality allowing a manager to create various drink recipes which may subsequently be dispensed to a user. The beverage dispensing system may also include management functions, such as creating or revising beverage recipes, creating or revising menus, creating or revising pouring schema, product management and inventory tracking, reviewing dispensing reporting history, and financial tracking, such as tracking volume, count, and sales of beverages which are dispensed by the system 10. The beverage dispensing system 10 is more fully described in U.S. Provisional Patent Application No. 61/271,632, which was filed on Jul. 23, 2009, and U.S. Non-Provisional patent application Ser. No. 13/165,403 entitled "Beverage Dispensing Assembly," filed on Jun. 21, 2011, both of which are incorporated herein and made a part hereof.

The beverage dispensing system dispenses beverages according to a session beverage menu. As will be described in greater detail below, the session beverage menu identifies the beverages that may be dispensed for a particular session. The session beverage menu is created from a global beverage menu and is based on the ingredients which are provided and the pouring schema.

Figure 2:
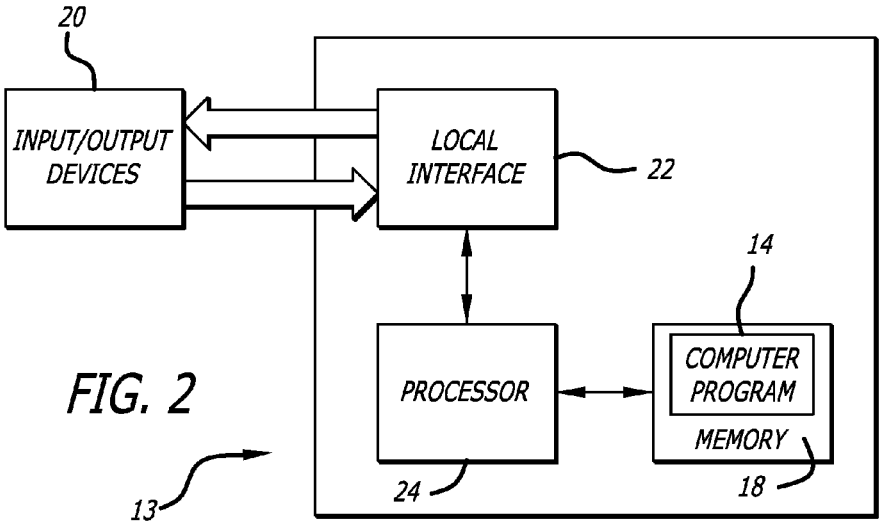
FIG. 2 is a block diagram illustrating a computer in the beverage dispensing system of FIG. 1.

FIG. 2 is a schematic diagram of the server 13 shown in the form of an executable computer program. Generally, the computer program is executed by one or more special or general purpose digital computer(s), such as a personal computer (PC; IBM-compatible, or otherwise), personal digital assistant, workstation, minicomputer, or mainframe computer.

Generally, in terms of hardware architecture, the server 13 includes a processor 24, memory 18, and one or more input and/or output (I/O) devices 20 (or peripherals) that are communicatively coupled via a local interface 22. The local interface 22 can be, for example, but not limited to, one or more buses or other wired or wireless connections, as is known in the art. The local interface 22 may have additional elements, which are omitted for simplicity, such as controllers, buffers (caches), drivers, repeaters, and receivers, to enable communications. Further, the local interface may include address, control, and/or data connections to enable appropriate communications among the other computer components. One or more input devices 20, the local interface 22, and/or the processor 24, alone or in combination, may form an input module. Similarly, one or more output devices 20, the local interface 22, and/or the processor 24, alone or in combination, may form an output module.

The processor 24 is a hardware device for executing software, particularly software 14 stored in memory 18. The processor 24 can be any custom made or commercially available processor, a central processing unit (CPU), an auxiliary processor among several processors associated with the server 13, a semiconductor based microprocessor (in the form of a microchip or chip set), a macroprocessor, or generally any device for executing software instructions. Examples of suitable commercially available microprocessors are as follows: a PA-RISC series microprocessor from Hewlett-Packard Company, an 80×86 or Pentium series microprocessor from Intel Corporation, a PowerPC microprocessor from IBM, a Sparc microprocessor from Sun Microsystems, Inc., or a 68xxx series microprocessor from Motorola Corporation.

The memory 18 can include any one or a combination of volatile memory elements (e.g., random access memory (RAM, such as DRAM, SRAM, SDRAM, etc.)) and nonvolatile memory elements (e.g., ROM, hard drive, tape, CDROM, etc.). Moreover, memory 18 may incorporate electronic, magnetic, optical, and/or other types of storage media. The memory 18 can have a distributed architecture where various components are situated remote from one another, but can be accessed by the processor.

The software 14 in memory 18 may include one or more separate programs, each of which comprises an ordered listing of executable instructions for implementing logical functions. The software 14 in the memory 18 of the server 13 includes a beverage dispensing computer program with support capabilities and a suitable operating system (O/S). An example of suitable commercially available operating systems is the Windows operating system available from Microsoft Corporation. The operating system controls the execution of the present computer program.

If the server 13 is a PC or workstation, the software 14 in the memory 18 may further include a basic input output system (BIOS). The BIOS is a set of essential software routines that initialize and test hardware at startup, start the O/S, and support the transfer of data among the hardware devices. The BIOS is stored in ROM so that the BIOS can be executed when the server 13 is activated.

When the server 13 is in operation, the processor is configured to execute software 14 stored within the memory 18, to communicate data to and from the memory 18, and to generally control operations of the server 13 pursuant to the software 14.

The beverage dispensing computer program may reside in, or have portions residing in, any computer such as, but not limited to, the server 13. The beverage dispensing computer program may be a source program, executable program (object code), script, or any other entity comprising a set of instructions to be performed. When a source program, the program needs to be translated via a compiler, assembler, interpreter, or the like, which may or may not be included within the memory 18, so as to operate properly in connection with the O/S. Furthermore, the beverage dispensing computer program can be written as (a) an object oriented programming language, which has classes of data and methods, or (b) a procedure programming language, which has routines, subroutines, and/or functions, for example, but not limited to. Visual Basic C, C++, Pascal, Basic, Fortran, Cobol, Perl, Java, and Ada. In one embodiment, the beverage dispensing computer program capabilities is written in Visual Basic.Net.

The I/O devices may include input devices, for example, but not limited to, a keyboard, mouse, scanner, microphone, touch screens, user interfaces, bar code readers, stylus, laser readers, radio-frequency device readers, etc. Furthermore, the I/O devices may also include output devices, for example, but not limited to, a printer, bar code printers, displays, universal serial bus ("USB") connections, etc. Finally, the I/O devices may further include devices that communicate both inputs and outputs, for instance, but not limited to, a modulator/demodulator (modem; for accessing another device, system, or network), a radio frequency (RF) or other transceiver, a telephonic interface, a bridge, a router, etc. As noted above, one type of I/O device used in the beverage dispensing system 10 is a touch screen user interface 21.

It should be noted that executable computer programs, such as the beverage dispensing computer program can be stored on any computer readable medium for use by or in connection with any computer related system or method. In the context of the invention, a computer-readable medium can be any means that can store, communicate, propagate, or transport the program for use by or in connection with the instruction execution system, apparatus, or device. The computer readable medium can be for example, but not limited to, an electronic, magnetic, optical, electromagnetic, infrared, or semiconductor system, apparatus, device, or propagation medium. More specific examples (a non-exhaustive list) of the computer-readable medium would include the following: an electrical connection (electronic) having one or more wires, a portable computer diskette (magnetic), a random access memory (RAM) (electronic), a read-only memory (ROM) (electronic), an erasable programmable read-only memory (EPROM, EEPROM, or Flash memory) (electronic), an optical fiber (optical), and a portable compact disc read-only memory (CDROM) (optical).

As described above, the dispensed beverage may be created from a first plurality of liquids, a second plurality of liquids, or a combination of one or more first and second plurality of liquids. Referring to FIGS. 1 and 2, the memory 18 may include pouring schema data, such as beverage recipes, which is used by the beverage dispensing system 10 to dispense the desired beverage. Each beverage is dispensed according to a pouring schema which is stored in the memory 18. The pouring schema may be preprogrammed by a system manager, or alternatively, be chosen by an operator during operation of the system. In addition, it is contemplated that the pouring schema may be programmed by another individual. In one embodiment, the first plurality of liquids may include liquors and the second plurality of liquids may include mixers which are mixed with the liquors to create the beverage, such as a beverage containing alcohol.

Figure 3:
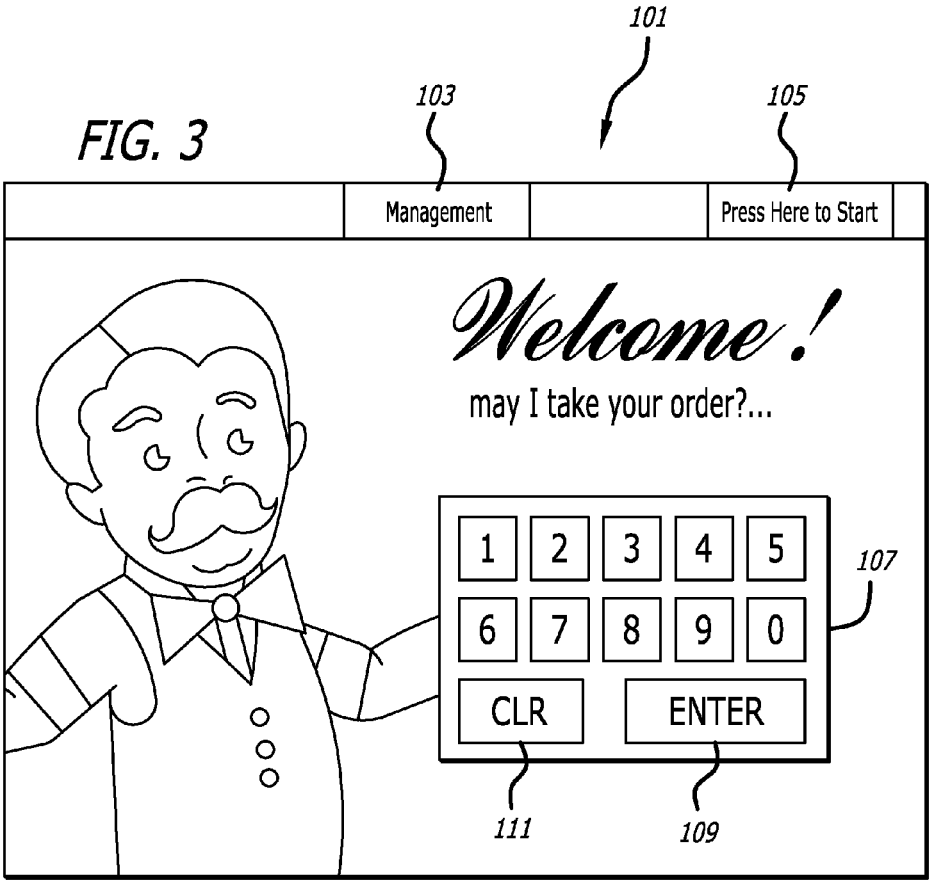
FIG. 3 is a screenshot of the entry screen that may be displayed on a display of the beverage dispensing system of FIG. 1.

As indicated above, the beverage dispensing system 10 may include management functions and dispensing functions. The management and dispensing functions may be accessed, programmed and/or controlled via the touch screen interface 21 for the beverage dispensing system 10. FIG. 3 illustrates a screenshot of the entry screen 101 that may be displayed on the touch screen interface 21. The entry screen 101 may include a management function button 103 and a dispensing function button 105. If the user selects the management function button 103, the system permits the user to access interfaces to control, program, or access various management functions. If the user selects that dispensing function button 105, the system permits the user to access interfaces for dispensing selected beverages. It is contemplated that the beverage dispensing computer program may be programmed to require the user to enter an authorization code to access to the management functions and/or dispensing functions. The authorization code may be a password which is composed of a numeric, alpha-numeric, or other characters which are entered via the user interface. Alternatively, the authorization code may be a fingerprint scan, retinal scan, or other types of biometric indicators. If a password is required, the entry screen 101 may also include a numeric or alpha-numeric keypad 107 for entry of the password. It is understood that access to interfaces for the management functions and access to interfaces for the dispensing functions may utilize the same password, or may require different passwords.

During operation, the operator may select the management function button 103. Preferably, the operator is a system manager. Upon selection of the management function button 103, a keypad 107 (of the type illustrated in FIG. 3) may be displayed. The operator may begin the password entry process by entering a password by depressing numbers on the keypad 107 and selecting the enter button 109. If the operator incorrectly selects an entry prior to selecting the enter button 109, the operator may select the clear button 111 to restart the password entry process. If the operator enters the correct password, operator may be provided with access to the management function of the system 10. If the operator enters an incorrect password, the operator will not be provided access to the management function of the system 10.

If the operator enters the correct password, operator is provided with access to the management function of the system 10. FIGS. 4A-4G illustrate a screenshots of the management function interfaces that may be displayed on the touch screen interface 21 when the operator is provided access to the management function of the system 10. The management function screen may include buttons that correspond to different management functions that may be implemented in the system 10. The management function screen may include a Reports button 115, a User Accounts button 117, a Bar Setup button 119, a Priming button 121, a Create a Drink button 123, and a Drink Glass Size button 125. An operator may select any of the tabs to access appropriate management functions, as will be described herein.

Figure 4A:
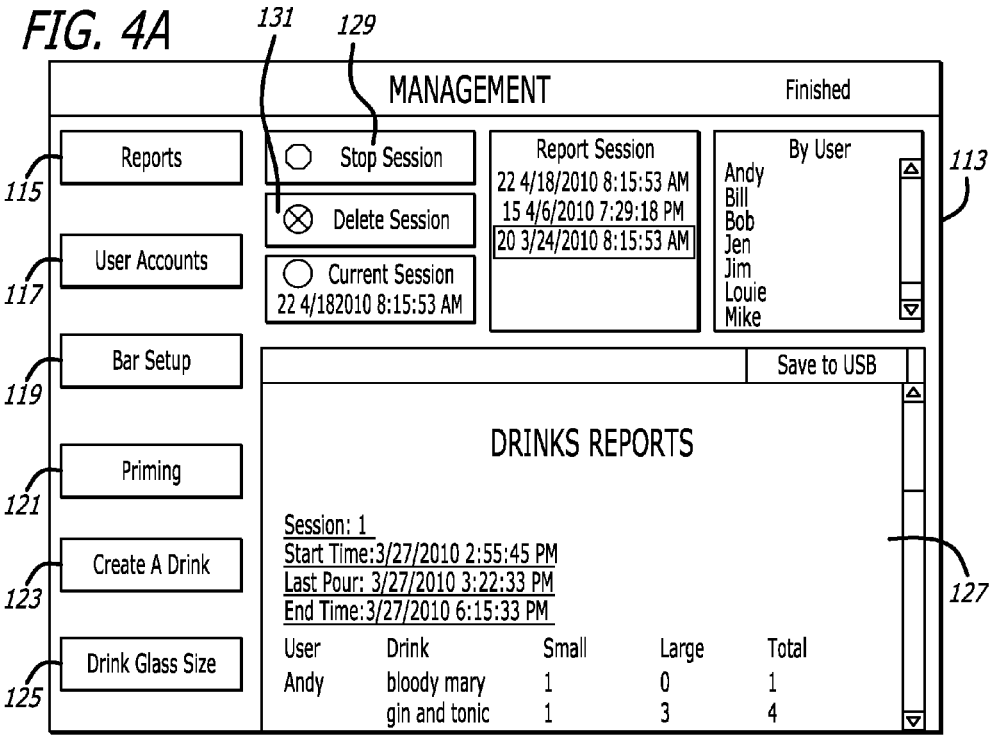
FIGS. 4A-4G are screenshots of the management function of the beverage dispensing system described herein; and, FIGS. 5A-5D are screenshots of the dispensing function of the beverage dispensing system described herein.

An operator may select the Reports button 115 to access reporting functions of the system 10. FIG. 4A illustrates a screenshot of the display under the Reports button 115. The system 10 may be programmed to track all beverages dispensed over a time period, referred to as a report session. Alternatively, the system 10 may also be programmed to provide a reporting session for particular user accounts, which may be selected in a By User selection box 133. The user may start the report session for a particular user by selecting the user's name from the By User selection box 133 and by selecting a start button (not shown). The operator may stop the report session for the selected consumer by selecting the stop button 129. The operator may also select a delete button 131 to delete the reporting session for the selected consumer.

A report 127 may be displayed on the display. The report may provide information regarding the reporting session, including the start time for the reporting session, the time the first and/or last beverage was dispensed, the end time for the reporting session, the consumer, the types of beverages consumed, and the total amount or volume of each different types and sizes of the beverages consumed. It is understood that other types of information may also be collected by the system 10 and displayed on the display. The report 127 may be saved to memory 18 for transfer to a financial, accounting, billing, or printing system. In one embodiment, the report 127 may be electronically transferred to a USB device using a USB connection in the automatic beverage dispensing unit.

Figure 4B:
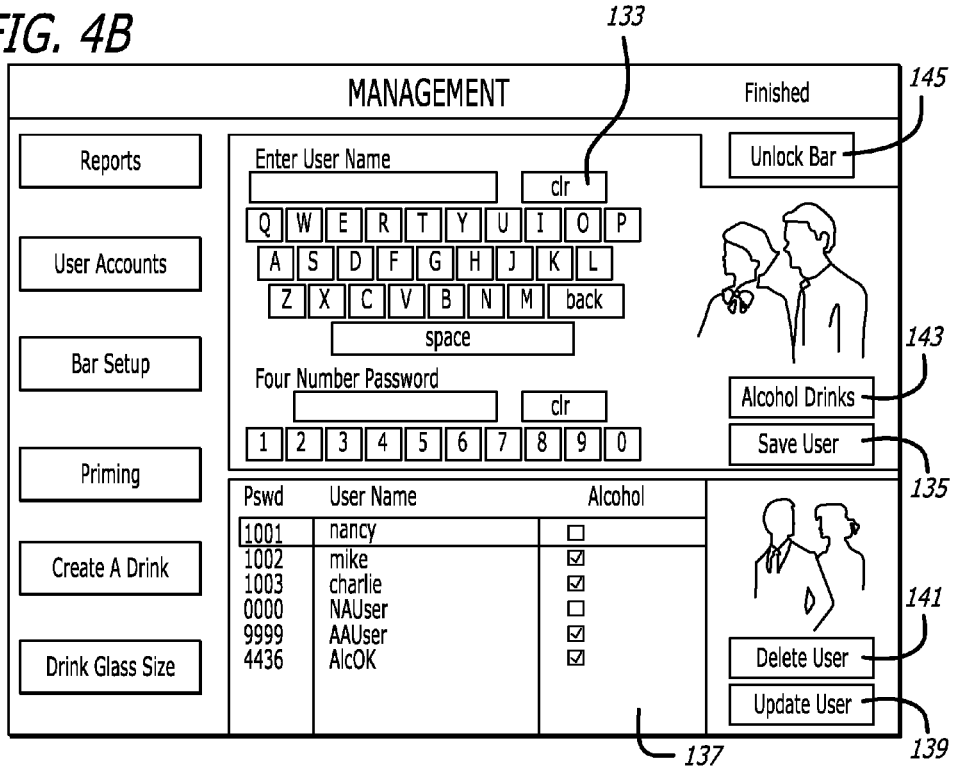

An operator may select the User Accounts button 117 to access user account functions of the system 10. FIG. 4B illustrates a screenshot of the display under the User Accounts button 117. The system 10 may be programmed to track all beverages dispensed over a time period for a particular user account. Typically, the user account identifies a particular consumer or group. Using the display for the User Accounts button 117, the operator may create, edit, and delete user accounts. The operator may create a new user account by entering a user's name using an alpha-numeric keypad 133 located on the display. Upon entering the user's information, the user account may be saved by selecting the Save User button 135. The operator may also be able to edit a user account by selecting a user account from the user account list 137 and revising information which requires revisions. Upon updating the user account with the appropriate information, the operating may save the user account by selecting the Update User button 139. The operator may also delete a user account by selecting a user account from the user account list 137 and selecting the Delete User button 141.

In addition, using this display for the User Accounts button 117 function, the user may set permissions to permit or prevent a particular user from having access to certain liquids, such as any type of liquid containing alcohol. When the operator is creating a new user account, the operator may select the Alcohol Drink check box 143 to indicate when the particular user account is selected for the dispensing function, the user may have access to beverages containing alcohol. If the operator does not select the Alcohol Drink check box 143 for a particular user account, when that selected user account is selected for the dispensing function, the user will not have access to beverages containing alcohol. As a result, the session menu for that particular user account will not contain any beverages containing alcohol. Alternatively, the operator may edit a user account to indicate whether the user may have access to beverages containing alcohol when the particular user account is selected for the dispensing function. In such situations, the session menu for that particular user account will contain beverages containing alcohol.

The operator may also use the display for the User Accounts button 117 to indicate that a password is not required. When the operator is creating a new user account, the operator may select the Unlock Bar check box 145 to indicate when the particular user account is selected for the dispensing function, the user may access the dispensing function without having to enter an authorization, such as a password. If the operator does not select the Unlock Bar check box 145 for a particular user account, when that selected user account is selected for the dispensing function, the user will have to enter a password to access the dispensing function. Alternatively, the operator may edit a user account to indicate that whether the user must enter an authorization before accessing the dispensing function.

Figure 4C:
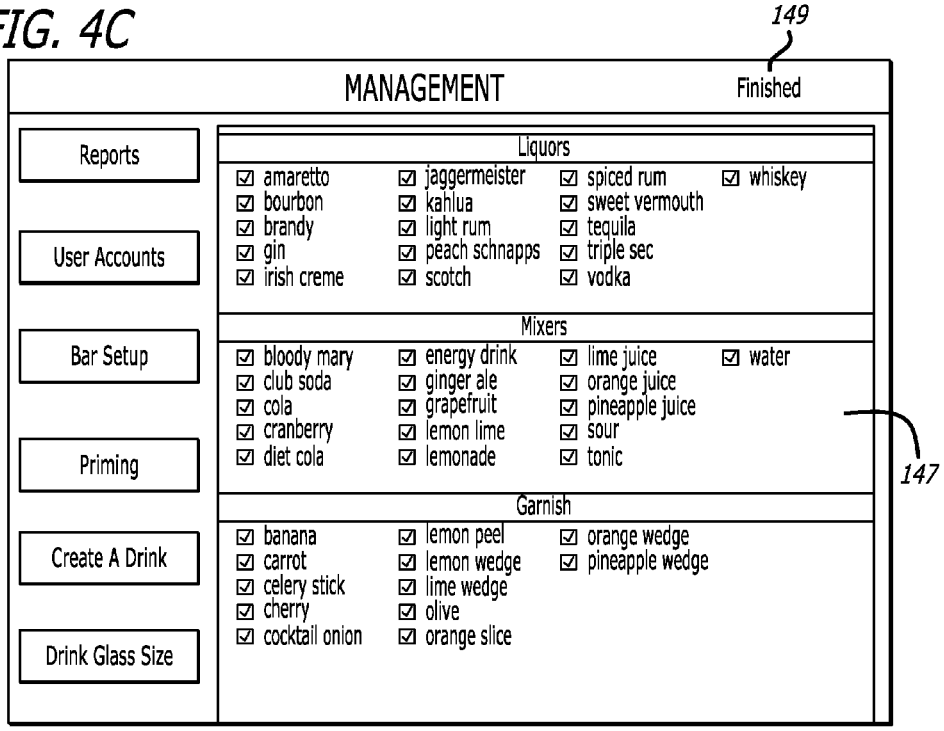

An operator may select the Bar Setup button 119 to access bar setup functions of the system 10. FIG. 4C illustrates a screenshot of the display under the Bar Setup button 119. Using the display for the Bar Setup button 119, the operator may identify the ingredients which are available to create beverages. A list of potential ingredients that may be available is provided in a table 147 on the display. The operator may check a check box next to a particular ingredient to indicate that the ingredient is available to create a beverage. Alternatively, the operator may uncheck a check box next to a particular ingredient to indicate that the ingredient is unavailable to create a beverage. Un-checking a check box next to a particular ingredient will remove from the session beverage menu any beverages containing that ingredient.

Figure 4D:
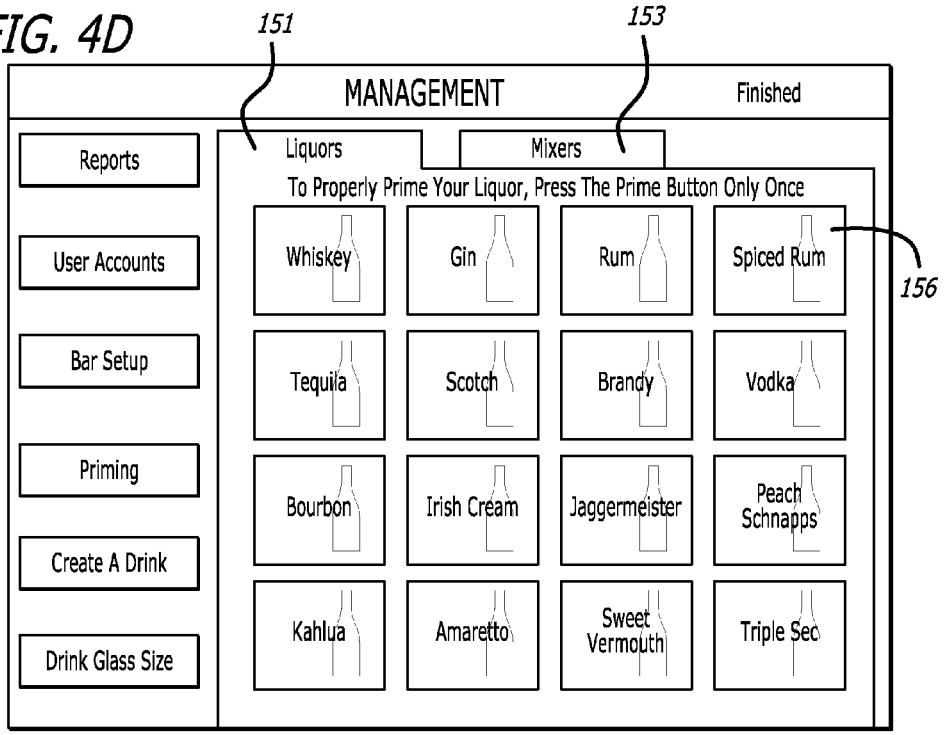
Figure 4E:
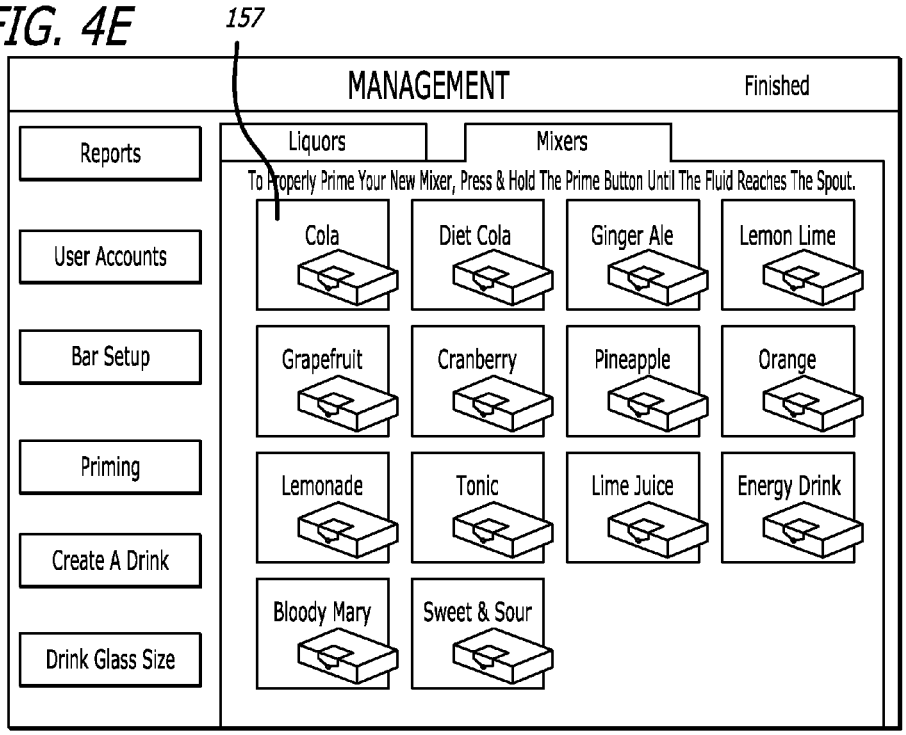

An operator may select the Priming button 121 to access the priming function of the system 10. One type of priming function is to energize the mechanisms which are required to prime the supply packs when a container for an ingredient, such as one of the first or second plurality of liquids, is emptied and replaced by another container containing the same ingredient. The containers for each of the first plurality of liquids is stored in the first storage location 17 and the containers for each of the second plurality of liquids is stored in the second storage location 19. FIGS. 4D-E illustrate screenshots of the display under the Priming button 121. When the Priming button is pressed, the display may include a first tab for a first plurality of liquids 151, such as liquors, and a second tab for a second plurality tab for a second plurality of liquids 153.

The operator may press the first tab 151 to access the priming function for the first plurality of liquids. As illustrated in FIG. 4D, under the first tab 151, the display may include a plurality of buttons 155. Preferably, each of the buttons 155 correspond to a particular liquid of the first plurality of liquids, such as, for example, whiskey, gin, rum, spiced rum, tequila, scotch, brandy, vodka, bourbon, Irish crème, Jagermeister®, peach schnapps, Kahlua®, amaretto, sweet vermouth, and triple sec. The operator may prime the supply path for a particular liquid by pressing the button 155 corresponding to the particular liquid and holding the button 155 corresponding to the particular liquid until the particular liquid appears at the dispense head.

The operator may press the second tab 153 to access the priming function for the second plurality of liquids. As illustrated in FIG. 4E, under the second tab 153, the display many include a plurality of buttons 157. Preferably, each of the buttons 157 corresponds to a particular liquid of the second plurality of liquids, such as, for example, cola, diet cola, ginger ale, lemon lime soda, grapefruit juice, cranberry juice, pineapple juice, orange juice, lemonade, tonic, lime juice, energy drink, bloody mary, and sweet & sour. The operator may prime the supply path for a particular liquid by pressing the button 157 corresponding to the particular liquid and holding the button 157 corresponding to the particular liquid until the particular liquid appears at the dispense head.

Figure 4F:
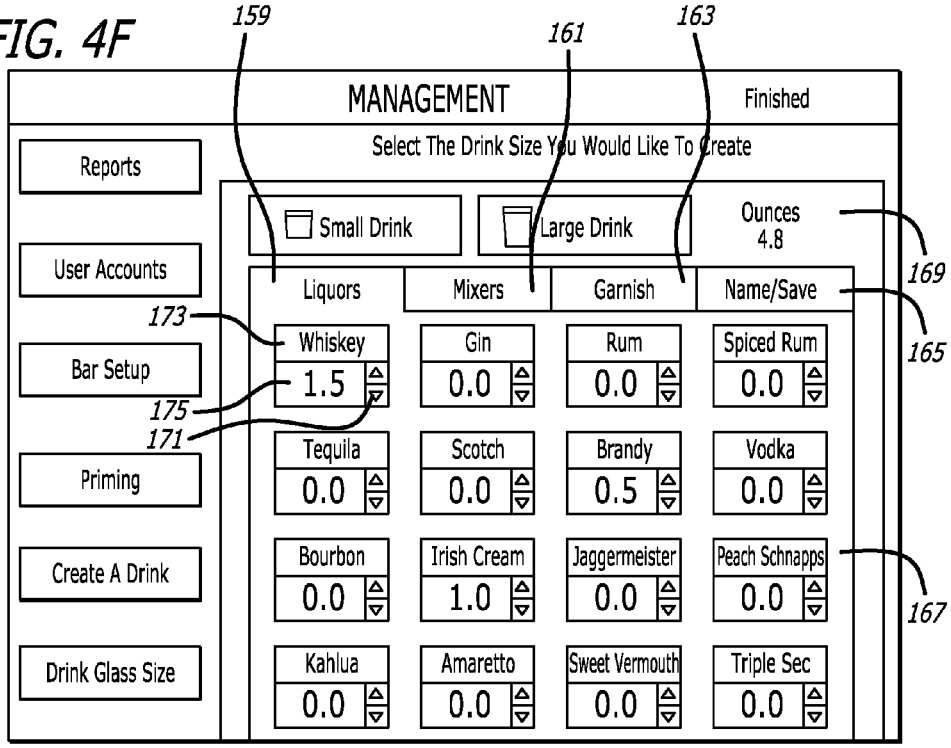

An operator may select the Creating a Drink button 123 to access recipe-related functions of the system 10. FIG. 4F illustrates a screenshot of the display when the Creating a Drink button 123 is pressed. Recipe-related functions may include creating or editing beverage pouring schemas, such as beverage recipes. This may include selecting or editing the size of a beverage, selecting or editing ingredients for a beverage, selecting or editing amounts of each ingredient for each beverage, and saving a beverage recipe to the beverage menu. The display for the recipe-related functions may include a first tab 159, a second tab 161, a third tab 163, and a fourth tab 165. The first tab 159, second tab 161, and third tab 163 may each correspond to different class of ingredients which may be used to create the pouring schema for the beverage that is dispensed. The class of ingredients may be, for example, the first plurality of liquids, the second plurality of liquids, and garnishes. As illustrated in the display shown in FIG. 4F, the first tab 159 may display a list of one or more of the first plurality of liquids. The second tab 161 may display a list of one or more of the second plurality of liquids and the third tab 163 may display a list of garnishes. When the Creating a Drink button 123 is pressed, information corresponding to the first tab 159 may be displayed. Alternatively, when the Creating a Drink button 123 is pressed, information corresponding to the second tab, 161, third tab 163, or fourth tab 165 may be displayed if one of the second, third, or fourth tabs is depressed. The display may also include a register 169 which includes a numerical value to indicate the amount of liquid that may added to the beverage recipe. As will be described below, as identified amounts of liquids are added to the beverage recipe, the value of the register may be decreased by the identified amount.

Upon selection of the first tab 159, a first plurality of liquids that may be used for creating a beverage may be displayed. The first plurality of liquids that are displayed may be based on the first plurality of liquids that were selected during Bar Setup as shown in FIG. 4C. Each of the first plurality of liquids may include indentifying indicia 167 that displays the identity of the first liquid 173 and the amount of the first identified liquid in the beverage recipe for the beverage that is to be dispensed. A spin-selector 171 may be provided to increase or decrease the amount of the identified liquid that should be included in the beverage. The operator may create or modify a beverage recipe by adding fractional doses of one of the first plurality of liquids using the spin-selector 173 located next to the identifying indicia 167 of a particular liquid 173 to be added or removed from the beverage. The fractional dosage may represent a fractional percentage of the selected liquid in the beverage. An amount representing the fractional percentage of the selected liquid that is added by the operator is deducted from the value shown in the register 169. When the value in the register 169 is zero, the system 10 prevents the operator from adding additional amounts of any liquid to the particular beverage recipe.

Upon selection of the second tab 161, a screen similar to the first tab 159 may be displayed. The second plurality of liquids that are displayed may be based on the second plurality of liquids that were selected during Bar Setup as shown in FIG. 4C. The second tab 161 may include a list of the second plurality of liquids that may be used for creating a beverage. Each of the second plurality of liquids may include indentifying indicia that displays the identity of the liquid and the amount of the identified liquid in the beverage. A spin-selector may be provided to increase or decrease the fractional amount of the second identified liquid that should be included in the beverage. The operator may create or modify a beverage recipe by adding fractional doses of one of the second plurality of liquids using the spin-selector located next to the identifying indicia of a particular liquid to be added or removed from the beverage. The fractional dosage may represent a fractional percentage of the selected liquid in the beverage. An amount representing the fractional percentage of the selected liquid that is added by the operator is deducted from the value shown in the register 169. When the value in the register 169 is zero, the system 10 prevents the operator from adding additional amounts of any liquid to a particular beverage recipe.

Upon selection of the third tab 163, a garnish selection screen similar to the first tab 159 and second tab 161 may be displayed. The garnishes that are displayed may be based on the garnishes that were selected during Bar Setup as shown in FIG. 4C. The third tab 163 may include a list of garnishes that may be used for creating a beverage. Each of the garnishes may include indentifying indicia that displays the identity of the garnish and the amount of the garnish in the beverage. A spin-selector may be provided to increase or decrease the amount of the garnish that should be included in the beverage. The operator may create or modify a beverage recipe by adding garnishes using the spin-selector located next to the identifying indicia of a particular liquid to be added or removed from the beverage.

Upon selection of the fourth tab 165, an alpha-numeric keypad (of the type illustrated in FIG. 4B) may be displayed. The operator may enter a name for the beverage and save the ingredients and amounts of each ingredient used to create the beverage. The beverage recipe may be stored in memory 18, or in another external memory location.

Figure 4G:
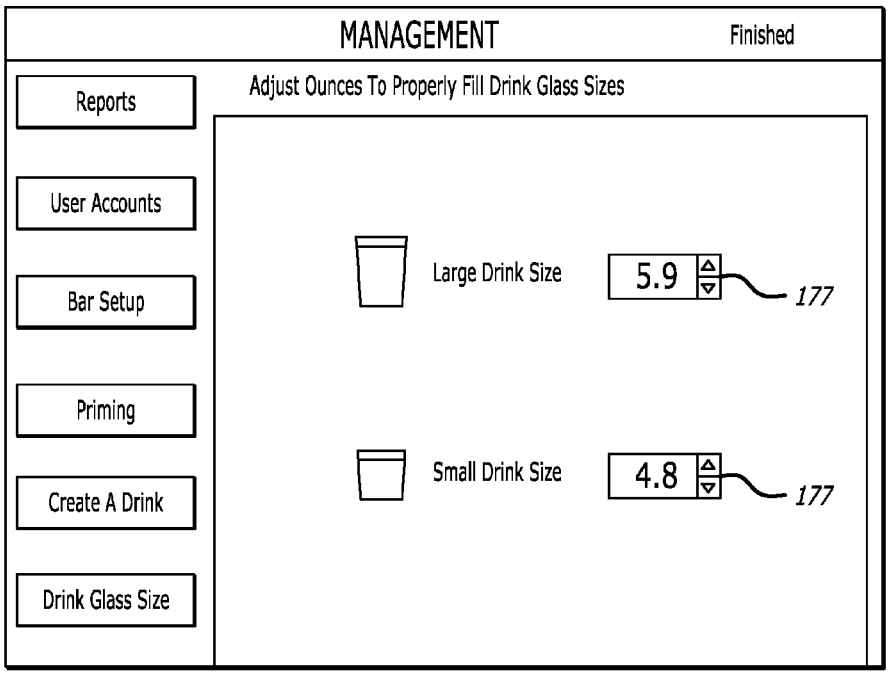

An operator may select the Drink Glass Size button 125 to access drink-size functions of the system 10. FIG. 4G illustrates a screenshot of the display when the Drink Glass Size button 123 is pressed. Drink-size functions may include adjusting the nominal liquid allowed according to the size of the container for the beverage. It is understood that one or more container sizes may be provided. For example, the interface may display a large drink size and a small drink size. A spin selector 177 may be provided to increase or decrease the nominal liquid allowed of each of the displayed drink sizes. Although only two drink sizes are displayed in FIG. 4G, it is understood that any number of drink sizes may be provided.

As discussed above, the nominal liquid allowed is displayed in the register 169, as shown in FIG. 4F. As selected amounts of liquid are added or removed from a beverage recipe, a corresponding selected amount is added or removed from the value displayed in the register 169.

As indicated above, the beverage dispensing system 10 may also include dispensing functions. The dispensing functions may be accessed via the touch screen interface 21 for the beverage dispensing system 10. Referring again to FIG. 3, the entry screen 101 may include a dispensing function button 105 which allows a user to access interfaces for dispensing selected beverages. It is contemplated that the beverage dispensing computer program may be programmed to require the user to enter an authorization to access the dispensing functions for a particular User Account. The authorization may be a password which is composed of a numeric, alphanumeric, or other characters which are entered via the user interface. Alternatively, the authorization may be a fingerprint scan, retinal scan, or other types of biometric indicators. If a password is required, the entry screen 101 may also include a numeric or alpha-numeric keypad 107 for entry of the password. It is understood that access to interfaces for the dispensing functions may utilize the same password as that which is used to access the management functions. Further, it is contemplated that no password may be required to access the interfaces for the dispensing functions.

During operation, a user may select the dispensing function button 105. If a password is required for access to the interfaces for the dispensing function for the selected User Account, a keypad (of the type illustrated in FIG. 3) may be displayed. The user may begin the password entry process by entering a password by depressing numbers on the keypad and selecting an enter button. If the user incorrectly selects a number prior to selecting the enter button, the user may select a clear button to restart the password entry process. If the user enters the correct password, operator may be provided with access to the dispensing function of the system 10. If the operator enters an incorrect password, the operator will not be provided access to the dispensing functions of the system 10.

If the user enters the correct password, the user is provided with access to the dispensing function of the system 10. Alternatively, if no password is required, the user is provided access to the dispensing function of the system upon selection of the dispensing function button 105. FIGS. 5A-5D illustrate a screenshots of the dispensing function interfaces that may be displayed on the touch screen interface 21 when a user is provided access to the dispensing function of the system 10.

Figure 5A:
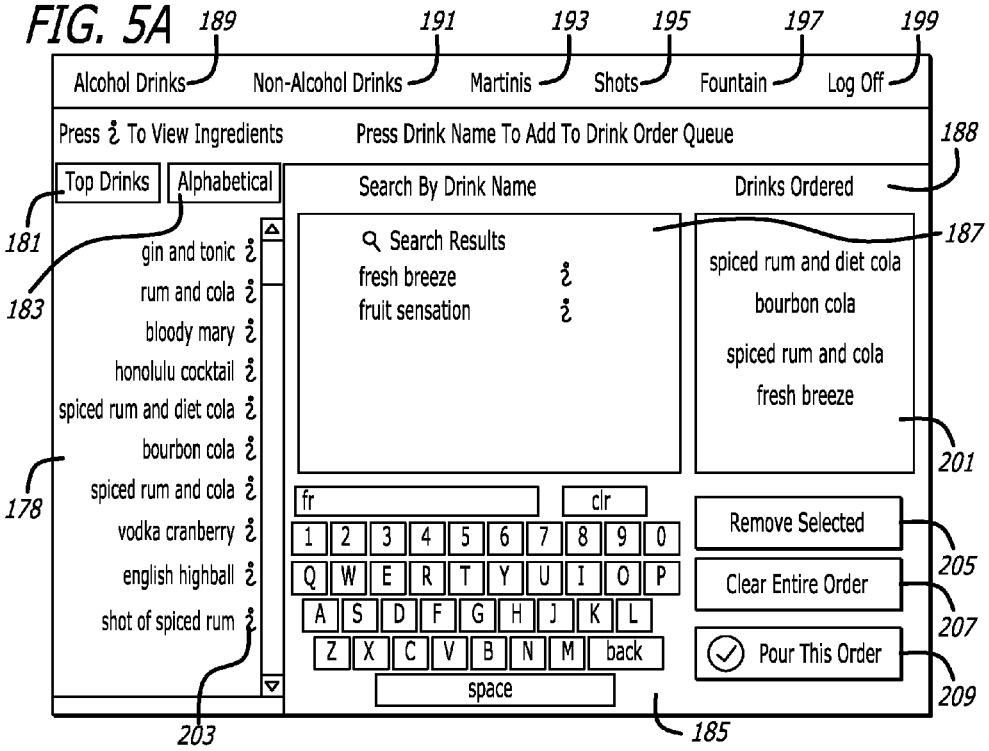

FIG. 5A illustrates a screenshot of the main dispensing function screen 188 from which a user may begin the process of dispensing a selected beverage. The main dispensing function screen 188 may include buttons which correspond to different categories of beverages which may be dispensed by the system 10. The dispensing function screen may include an Alcohol Drinks button 189, a Non-Alcoholic Drinks button 191, a Martinis button 193, a Shots button 195, and a Fountain button 197. A user may select any of the buttons to display beverages that match the category to which the selected button relates, as will be described herein.

A user may select the Alcohol Drinks button 189, to display and order alcohol beverages. The display may include a list of beverages 179 which may be dispensed by the system 10. Each of the alcoholic beverages in the list of alcoholic beverages 179 is dispensed according to a pouring schema for that alcoholic beverage. The alcoholic beverages in the list of alcoholic beverages 179 may be arranged by popularity according to the number of times the alcoholic beverage has been order in a selected session or over multiple sessions. Alternatively, the alcoholic beverages in the list of alcoholic beverages may be arranged alphabetically. A Top Drinks button 181 and an Alphabetical button 183 may be provided on the interface. A user may select the Top Drinks button 181 to display the alcoholic beverages in the list of alcoholic beverages 179 by popularity. Alternatively, a user may select the Alphabetical button 183 to display the alcoholic beverages in the list of alcoholic beverages in alphabetical order. Each of the alcoholic beverages in the list of alcoholic beverages 179 may include a corresponding information button 203. A user may select the information button 203 corresponding to an alcoholic beverage to display information regarding the beverage. Such information may include the ingredients in the beverage recipe or the amount of each of the ingredients in the beverage recipe for the alcoholic beverage.

The user may select an alcoholic beverage to dispense by selecting an alcoholic beverage from the list of alcoholic beverages 179. Upon selection of the alcoholic beverage from the list of alcoholic beverages 179, the name of the selected alcoholic beverage to be dispensed is displayed in a Drinks Ordered list 201.

The beverage dispensing system 10 may also include a search function which allows a user to search for alcoholic beverages based on search criteria. The search criteria may be, for example, the name of an alcoholic beverage, portions of the name of the alcoholic beverage, or ingredients that are used to create an alcoholic beverage. The display (illustrated in FIG. 5A) may include an alpha-numeric keyboard 185 for entry of search criteria to search for alcoholic beverages that satisfy the search criteria. The results of the search may be displayed in a Search Results list 187. The user may select an alcoholic beverage to dispense by selecting the alcoholic beverage from the Search Results list 187. Upon selection of the alcoholic beverage from the Search Results list 187, the name of the selected alcoholic beverage to be dispensed is displayed in the Drinks Ordered list 201.

A user may select the Non-Alcohol Drinks button 191, to display and order non-alcohol beverages. Similar to the display when the Alcohol Drinks button 189 is selected, the display when the Non-Alcohol Drinks button 191 is selected may include a list of non-alcoholic beverages which may be dispensed by the system 10. Each of the non-alcoholic beverages in the list of non-alcoholic beverages is dispensed according to a pouring schema for that non-alcoholic beverage. The non-alcoholic beverages in the list of non-alcoholic beverages may be arranged by popularity according to the number of times the non-alcoholic beverage has been order in a selected session or over multiple sessions. Alternatively, the non-alcoholic beverages in the list of non-alcoholic beverages may be arranged alphabetically. A Top Drinks button and an Alphabetical button may be provided on the interface. A user may select the Top Drinks button to display the non-alcoholic beverages in the list of non-alcoholic beverages by popularity. Alternatively, a user may select the Alphabetical button to display the non-alcoholic beverages in the list of non-alcoholic beverages in alphabetical order. Each of the non-alcoholic beverages in the list of non-alcoholic beverages may include a corresponding information button. A user may select the information button corresponding to a non-alcoholic beverage to display information regarding the non-alcoholic beverage. Such information may include the ingredients in the beverage recipe or the amount of each of the ingredients in the beverage recipe of the non-alcoholic beverage.

The user may select a non-alcoholic beverage to dispense by selecting a non-alcoholic beverage from the list of non-alcoholic beverages. Upon selection of the non-alcoholic beverage from the list of non-alcoholic beverages, the name of the selected non-alcoholic beverage to be dispensed is displayed in a Drinks Ordered list 201.

The beverage dispensing system 10 may also include a search function which allows a user to search for non-alcoholic beverages based on search criteria. The search criteria may be, for example, the name of a beverage, portions of the name of the non-alcoholic beverage, or ingredients that are used to create a non-alcoholic beverage. The display may include an alpha-numeric keyboard for entry of search criteria to search for non-alcoholic beverages that satisfy the search criteria. The results of the search may be displayed in a Search Results list. The user may select a non-alcoholic beverage to dispense by selecting a non-alcoholic beverage from the Search Results list. Upon selection of the non-alcoholic beverage from the Search Results list, the name of the selected beverage to be dispensed is displayed in the Drinks Ordered list 201.

A user may select the Martinis button 193, to display and order Martini beverages. Similar to the display when the Alcohol Drinks button 189 is selected, the display when the Martini button 193 is selected may include a list of Martini beverages which may be dispensed by the system 10. Each of the Martini beverages in the list of Martini beverages is dispensed according to a pouring schema for that Martini beverage. The Martini beverages in the list of Martini beverages may be arranged by popularity according to the number of times the Martini beverage has been order in a selected session or over multiple sessions. Alternatively, the Martini beverages in the list of Martini beverages may be arranged alphabetically. A Top Drinks button and an Alphabetical button may be provided on the interface. A user may select the Top Drinks button to display the Martini beverages in the list of Martini beverages by popularity. Alternatively, a user may select the Alphabetical button to display the Martini beverages in the list of Martini beverages in alphabetical order. Each of the Martini beverages in the list of Martini beverages may include a corresponding information button. A user may select the information button corresponding to a Martini beverage to display information regarding the Martini beverage. Such information may include the ingredients in the beverage recipe or the amount of each of the ingredients in the beverage recipe of the Martini beverage.

The user may select a Martini beverage to dispense by selecting a Martini beverage from the list of Martini beverages. Upon selection of the Martini beverage from the list of Martini beverages, the name of the selected Martini beverage to be dispensed is displayed in a Drinks Ordered list 201.

The beverage dispensing system 10 may also include a search function which allows a user to search for Martini beverages based on search criteria. The search criteria may be, for example, the name of a beverage, portions of the name of a Martini beverage, or ingredients that are used to create a Martini beverage. The display may include an alpha-numeric keyboard for entry of search criteria to search for Martini beverages that satisfy the search criteria. The results of the search may be displayed in a Search Results list. The user may select a Martini beverage to dispense by selecting a Martini beverage from the Search Results list. Upon selection of the Martini beverage from the Search Results list, the name of the selected beverage to be dispensed is displayed in the Drinks Ordered list 201.

Beverages may be individually or collecting removed from the Drink Order list 201 using a Remove Selected button 205 and/or a Clear Entire Order button 207. The user may select a beverage from the Drinks Order list 201 and select the Remove Selected button 205 to individually remove the selected beverage from the Drinks Order list 201. The user may select the Clear Entire Order button 207 to collectively remove each of the beverages listed in the Drinks Order list 201.

Figure 5B:
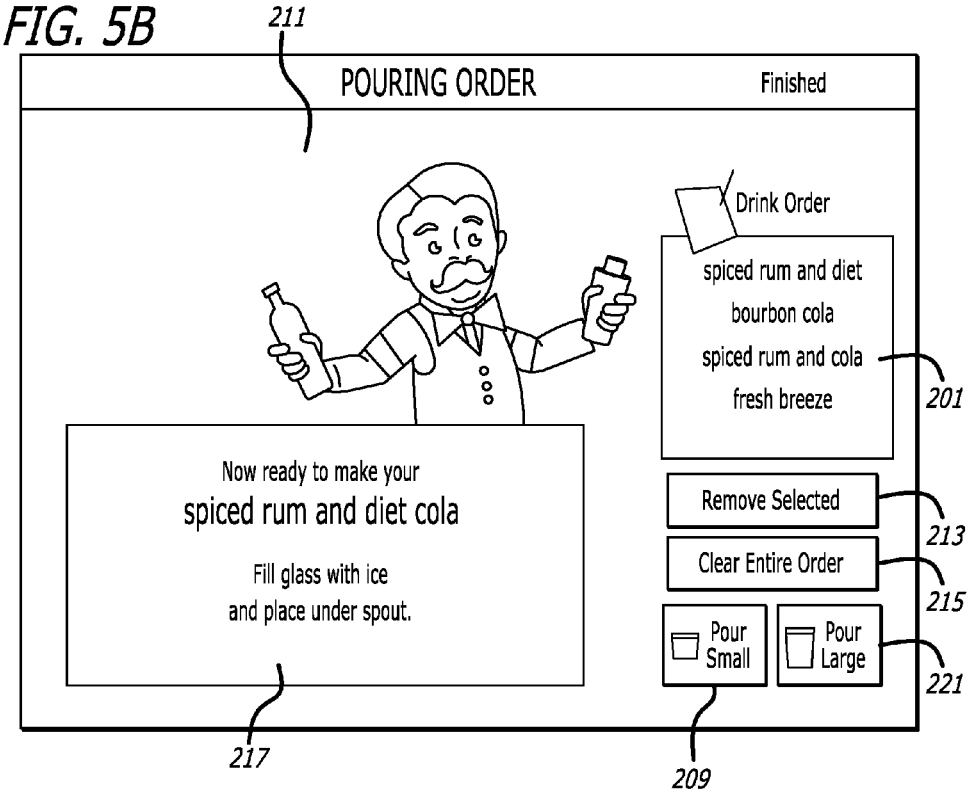

When the entire order has been entered into the system 10, the user may select the Pour This Order button 209 to dispense beverages listed in the Drinks Order list 201. Upon selection of the Pour This Order button 209, a Pouring Order screen 211 may be displayed. FIG. 5B illustrates a screenshot of the Pouring Order screen 211. The Drinks Order list 201 is duplicated on the Pouring Order screen 211. Beverages may be individually or collecting removed from the Drink Order list 201 using a Remove Selected button 213 and/or a Clear Entire Order button 215. The user may select a beverage from the Drinks Order list 201 and select the Remove Selected button 213 to individually remove the selected beverage from the Drinks Order list 201. The user may select the Clear Entire Order button 215 to collectively remove each of the beverages listed in the Drinks Order list 201.

The Pouring Order screen 211 may include a text box 217. The text box 217 may include text with instructions for the user. For example, the text box 217 may include text prompting the user to fill a container with ice and place it under the beverage dispensing apparatus 15 from which the beverage will be dispensed. The Pouring Order screen 211 may include a Pour Small button 219 and a Pour Large button 221. The user may select the Pour Small button 219 to dispense a small beverage according to the beverage recipe and pouring schema for the selected beverage. Alternatively, the user may select the Pour Large button 221 to dispense a large beverage according to the beverage recipe and pouring schema for the selected beverage.

Figure 5C:
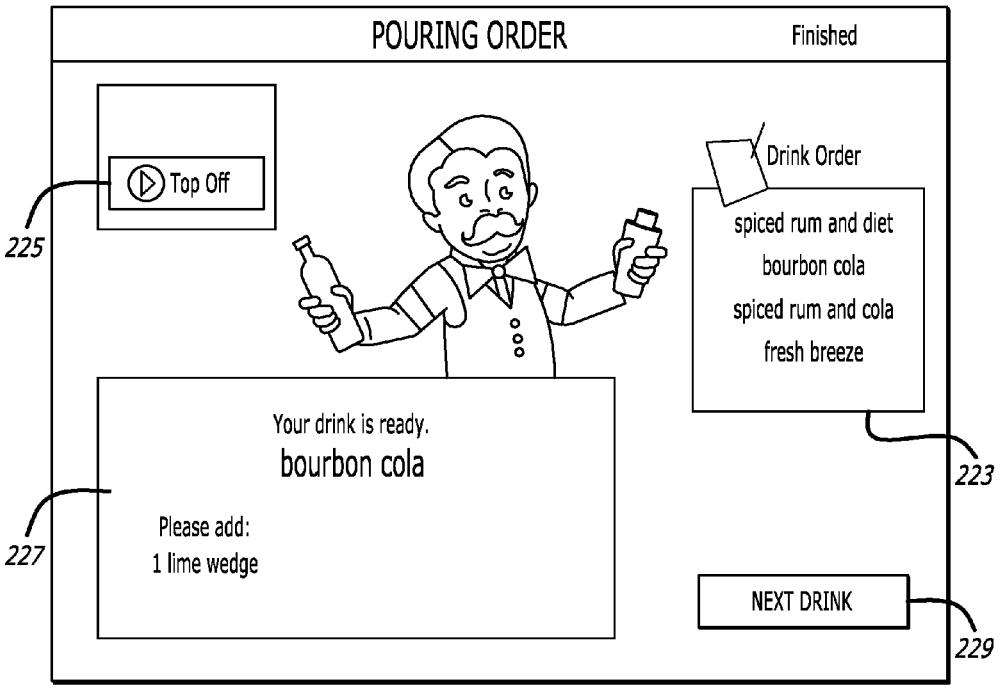
Figure 5D:
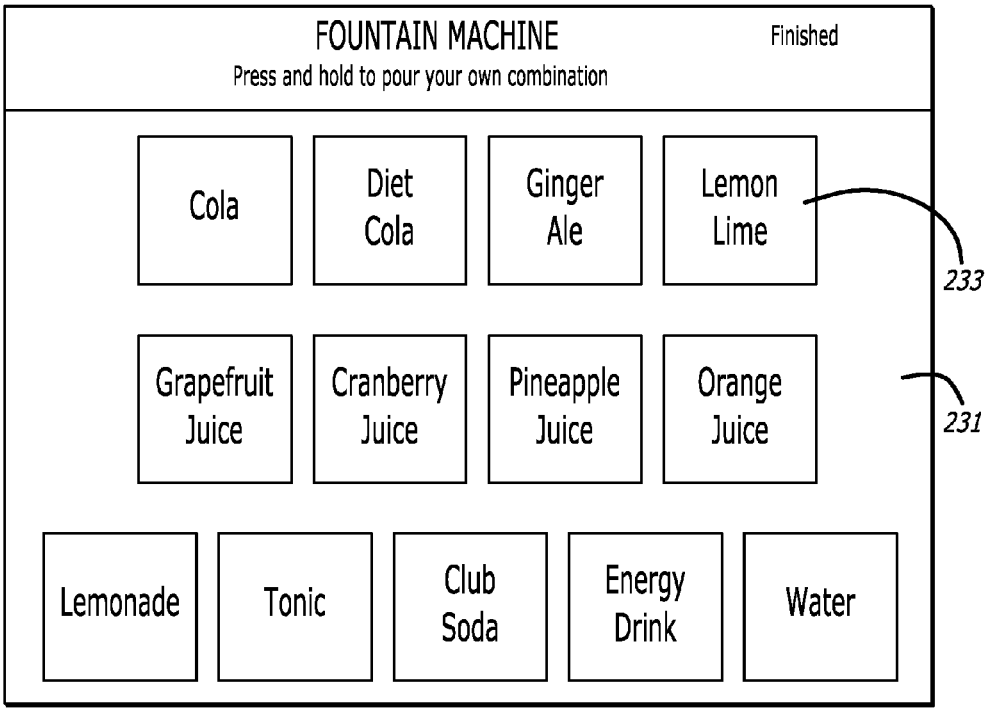

Upon selection of the Pour Small button 219 and a Pour Large button 221, the selected beverage is dispensed according to the beverage recipe and pouring schema for the selected beverage. Based on the beverage recipe and pouring schema, the server 13 dispenses the requisite amount the requisite liquids from the necessary containers of the first plurality of liquids stored in the first storage location 17, and dispenses the requisite amount of liquids from the necessary containers of the second plurality of liquids stored in the second storage location 19. After the beverage is dispensed, a beverage dispensed screen 223 may be displayed. FIG. 5C illustrates a screenshot of the beverage dispensed screen 223 that may be displayed on the touch screen interface 21. The beverage dispensed screen 223 may include a Top Off button 225. The user may select the Top Off button 225 to add more of the last one of the second plurality of liquids which was dispensed to create the beverage. The beverage dispensed screen 223 may also include a text box 227. The text box 227 may include text indicating that the selected beverage has been fully dispensed and may also prompt the user to add a garnish.

The user may select the Next Drink button 229 to repeat the beverage dispensing procedure for other beverages listed in the Drinks Order list 201. The process described above repeats until all beverages listed in the Drinks Order list 201 have been dispensed or removed from the Drinks Order list 201. After all beverages listed in the Drinks Order list 201 have been dispensed or removed from the Drinks Order list 201, the main dispensing function screen 188 (as illustrated in FIG. 5A) is displayed.

As noted above, the main dispensing function screen 188 includes a Fountain button 197. A user may select the Fountain button 197 to begin the process of dispensing a fountain beverage. Upon selection of the Fountain button 197, a fountain machine screen 231 may be displayed. FIG. 5C illustrates a screenshot of the fountain machine screen 231 that may be displayed on the touch screen interface 21. The fountain machine screen 231 includes a plurality of fountain beverage buttons 233 wherein each fountain beverage button 233 corresponds to a fountain beverage. In order to dispense a fountain beverage, the user may place a container under the beverage dispensing apparatus 15 from which the beverage will be dispensed. The user may dispense a desired fountain beverage by selecting the fountain beverage button 233 and holding the button until the desired amount of the fountain beverage is dispensed. Alternatively, the system 10 may be programmed so that the user selects the fountain beverage button 233 and the system automatically dispenses a predetermined amount of the fountain beverage.

While the foregoing has described what is considered to be the best mode and/or other examples, it is understood that various modifications may be made therein and that the subject matter disclosed herein may be implemented in various forms and examples, and that they may be applied in numerous other applications, combinations and environments, only some of which have been described herein. Those of ordinary skill in that art will recognize that the disclosed aspects may be altered or amended without departing from the true spirit and scope of the subject matter. Therefore, the subject matter is not limited to the specific details, exhibits and illustrated examples in this description. It is intended to protect any and all modifications and variations that fall within the true scope of the advantageous concepts disclosed herein.

What is claimed is:

1. A system for managing the dispensing of beverages from an automatic beverage dispensing unit, comprising:

an input module configured to receive one or more pouring schema, wherein each of the one or more pouring schema is a beverage recipe, and the input module is configured to allow selection of at least one criteria to be used in the beverage recipe;

a memory for storing the one or more pouring schema;

a processor for processing the one or more pouring schema;

an output module for displaying instructions based on the one or more pouring schema and for displaying a drink order list comprising drinks that have been ordered but not dispensed, and wherein the input module is configured to provide for selection and removal of a beverage from the drink order list.

2. The system of claim 1, wherein the system comprises a plurality of user accounts and the received one or more pouring schema is associated with at least one of the plurality of user accounts.

3. The system of claim 1, comprising a beverage dispensing unit setup module configured to select criteria available for use for a pouring schema.

4. The system of claim 1, wherein the criteria comprises at least one of selecting at least one ingredient to be used in the beverage recipe, selecting the size of the beverage, and selecting the amount of the at least one ingredient to be used in the beverage recipe.

5. The system of claim 1, wherein the beverage recipe comprises one of a first plurality of liquids and one of a second plurality of liquids, wherein the first plurality of liquids comprises liquor and the second plurality of liquids comprises mixers.

6. The system of claim 5, wherein at least one of the one or more pouring schema comprises mixing at least one of the first plurality of liquids with at least one of the second plurality of liquids.

7. The system of claim 1, comprising an access module for setting access permissions for access to at least one of the one or more pouring schema.

8. The system of claim 1, comprising a second input module for receiving a beverage request for a beverage corresponding to a beverage recipe, wherein the processor processes the pouring schema corresponding to the beverage recipe.

9. The system of claim 1, comprising a second memory for storing information relating to one or more beverages dispensed by the system during a report session, wherein the information includes at least one of the number of beverages dispensed over the report session, the start time for the report session, time the first beverage is dispensed, the time the last beverage is dispensed, the end time for the report session, the type of consumer, the types of beverages dispensed, the total volume of beverages dispensed, and the size of the beverages dispensed.

10. The system of claim 1, wherein the automatic beverage dispensing unit comprises a supply pack containing one or more ingredients to be used with at least one of the one or more pouring schema.

11. The system of claim 10, comprising a priming input module for receiving priming instructions for energizing one or mechanisms for priming at least one supply pack.

12. A system for managing the dispensing of beverages from an automatic beverage dispensing unit, comprising:

an input module configured to receive one or more pouring schema, wherein each of the one or more pouring schema is a beverage recipe, and the input module is configured to allow selection of at least one criteria to be used in the beverage recipe;

a memory for storing the one or more pouring schema;

a processor for processing the one or more pouring schema; and, an output module for displaying instructions based on the one or more pouring schema and for displaying a drink order list comprising drinks that have been ordered but not dispensed, wherein the input module is configured to provide for selection and removal of all beverages from the drink order list.

* * * * *